US010683728B2

(12) United States Patent
Kellner et al.

(10) Patent No.: US 10,683,728 B2
(45) Date of Patent: Jun. 16, 2020

(54) FLOAT SUB WITH PRESSURE-FRANGIBLE PLUG

(71) Applicant: INNOVEX DOWNHOLE SOLUTIONS, INC., The Woodlands, TX (US)

(72) Inventors: Justin Kellner, Adkins, TX (US); Stephen J. Chauffe, The Woodlands, TX (US); Wayland Dale Connelly, Montgomery, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 34 days.

(21) Appl. No.: 16/018,903

(22) Filed: Jun. 26, 2018

(65) Prior Publication Data

US 2018/0371869 A1 Dec. 27, 2018

Related U.S. Application Data

(60) Provisional application No. 62/525,566, filed on Jun. 27, 2017.

(51) Int. Cl.

| | |
|---|---|
| ***E21B 34/06*** | (2006.01) |
| ***E21B 33/12*** | (2006.01) |
| ***E21B 17/08*** | (2006.01) |
| ***E21B 21/10*** | (2006.01) |
| ***E21B 33/14*** | (2006.01) |

(52) U.S. Cl.

CPC ..... *E21B 34/063* (2013.01); *E21B 17/08* (2013.01); *E21B 21/10* (2013.01); *E21B 21/103* (2013.01); *E21B 33/1208* (2013.01); *E21B 33/14* (2013.01)

(58) Field of Classification Search

CPC ..... E21B 34/063; E21B 17/08; E21B 21/10; E21B 21/103; E21B 33/1208; E21B 33/14

USPC ..... 166/317

See application file for complete search history.

(56) References Cited

U.S. PATENT DOCUMENTS

| | | | | |
|---|---|---|---|---|
| 6,450,263 | B1 | 9/2002 | Schwendemann | |
| 7,806,189 | B2 | 10/2010 | Frazier | |
| 9,593,542 | B2 | 3/2017 | Getzlaf et al. | |
| 10,465,445 | B2 | 11/2019 | Getzlaf et al. | |
| 2014/0216756 | A1* | 8/2014 | Getzlaf | E21B 7/20 166/376 |
| 2016/0290096 | A1 | 10/2016 | Tse et al. | |
| 2016/0333668 | A1 | 11/2016 | Xu et al. | |
| 2017/0138153 | A1 | 5/2017 | Getzlaf et al. | |

FOREIGN PATENT DOCUMENTS

WO 2016/037281 A1 3/2016

OTHER PUBLICATIONS

Tae Wook Park (Authorized Officer), International Search Report and Written Opinion dated Oct. 22, 2018, PCT Application No. PCT/US2018/039744, filed Jun. 27, 2018, pp. 1-15.

* cited by examiner

*Primary Examiner* — Matthew R Buck
*Assistant Examiner* — Patrick F Lambe
(74) *Attorney, Agent, or Firm* — MH2 Technology Law Group LLP

(57) ABSTRACT

An apparatus for use in a string of tubulars includes a first sub having a bore, a second sub attached to the first sub, the second sub having a bore in fluid communication with the bore of the first sub, and a barrier assembly having a frangible member that is configured to break by applying a fluid pressure to the barrier.

20 Claims, 9 Drawing Sheets

FLOAT SUB WITH PRESSURE-FRANGIBLE PLUG

CROSS-REFERENCE TO RELATED APPLICATIONS

This application claims priority to U.S. Provisional Patent Application Ser. No. 62/525,566, which was filed on Jun. 27, 2017 and is incorporated herein by reference in its entirety.

BACKGROUND

After a wellbore is drilled, a casing string is lowered into the wellbore. While running the casing string in the wellbore, it is often the practice to cause the well fluid to sustain a portion of the weight of the casing string by floating the casing string in the well fluid. Typically, plugs (or packers) are installed inside the casing string to isolate a portion of the casing string. The isolated portion of the casing string may be filed with a low-density fluid or air to create a buoyant force when the casing string is lowered into the wellbore. The plugs (or packers) are eventually removed from the casing string by a costly drilling operation. Therefore, there is a need for a casing float sub that may be selectively removed from the casing string without the need of a drilling operation.

SUMMARY

Embodiments of the disclosure may provide an apparatus for use in a string of tubulars. The apparatus includes a first sub having a bore, a second sub attached to the first sub, the second sub having a bore in fluid communication with the bore of the first sub, and a barrier assembly having a frangible member that is configured to break by applying a fluid pressure to the barrier.

Embodiments of the disclosure may also provide a method of placing a string of tubulars in a wellbore. The method includes installing a float sub in the string of tubulars to form an isolated portion in the string of tubulars, the float sub including a frangible member, placing a low-density fluid or gas in the isolated portion of the string of tubulars, and lowering the string of tubulars into the wellbore. The low-density fluid or gas creates a buoyant force in the string of tubulars to facilitate placing the string of tubulars in the wellbore. The method also includes applying a fluid pressure in the string of tubulars to break the frangible member of the float sub after the string of tubulars is placed in the wellbore.

Embodiments of the disclosure may further provide a debris catcher for use in a string of tubulars, the string of tubulars having a float tool. The debris catcher includes a body with a first end and a second end, the body includes a catch surface between the first end and the second end that is configured to catch debris. The body further includes a plurality of ports with a port geometry that results in a combined flow area equal or greater than a flow area through the float tool after the catch surface of the body is filled with debris.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1A:
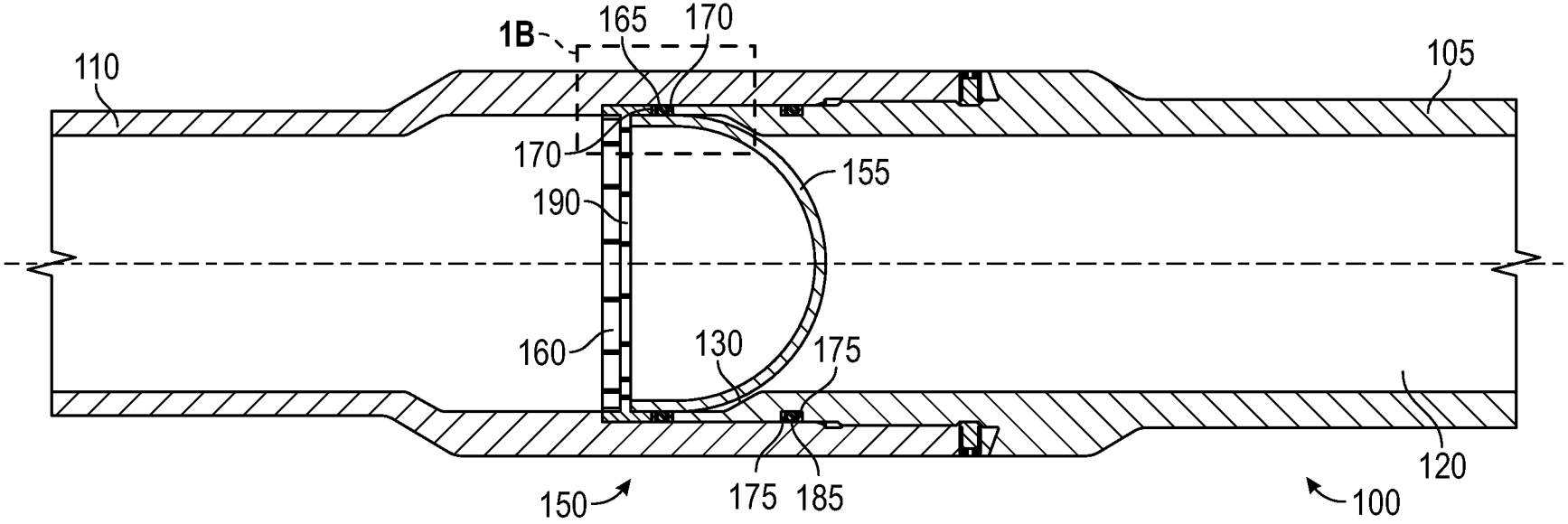
FIG. 1A illustrates a side, cross-sectional view of a float sub, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, embodiments of the present disclosure provide a casing float sub for use during an installation procedure of a casing string (e.g., string of tubulars) in a wellbore. The float sub may include a frangible member that is configured to break upon application of a predetermined pressure and, e.g., without employing a separate member to mechanically break the frangible member.

Turning now to the specific, illustrated embodiments, FIG. 1A illustrates a side, cross-sectional view of a float sub 100, according to an embodiment. The float sub 100 includes a first sub 105, a barrier assembly 150, and a second sub 110. The first sub 105 may be uphole of the second sub 110. The float sub 100 further includes a screw member between the first sub 105 to the second sub 110. As will be described herein, a portion of the barrier assembly 150 is configured to shatter (or break apart) upon application of a predetermined pressure.

The float sub 100 is configured to be placed in a string of tubulars that includes a float tool, such as a float shoe or float collar. The float sub 100 and the float tool define an isolated portion of the string of tubulars. The float sub 100 and the float tool are configured to substantially seal off the isolated portion from the fluid in the wellbore. In other words, the float sub 100 forms a temporary isolation barrier in the isolated portion. The isolated portion may be filled with a low density fluid and/or gas (or air) to create a buoyant force when the string of tubulars is lowered into the wellbore. The buoyant force may be used to assist the placement of the string of tubulars in the wellbore. The float sub 100 is placed at a predetermined location away from the float tool, such that a frangible member 155 of the barrier assembly 150 does not prematurely break by hydraulic or hydrostatic pressure when running the string of tubulars into the wellbore. In one embodiment, the float sub 100 is placed in a vertical portion of a deviated wellbore and the float tool is placed in the horizontal portion of the deviated wellbore.

Figure 1B:
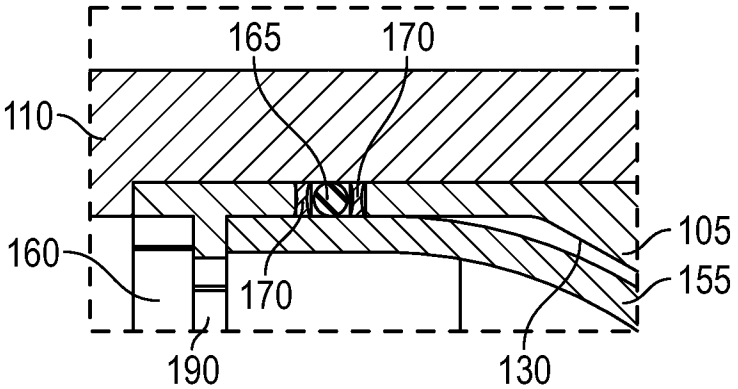
FIG. 1B is an enlarged portion of FIG. 1A.

FIG. 1B is an enlarged portion of FIG. 1A. As shown, a first seal member 165 is disposed between the barrier assembly 150 and the second sub 110. A second seal member 185 is disposed between the first sub 105 to the second sub 110. The seal members 165, 185 are configured to create a fluid tight seal between the subs 105, 110 and the barrier assembly 150.

As shown in FIGS. 1A and 1B, backup rings 170 are disposed adjacent each side of the first seal member 165. The backup rings 170 are configured to enhance the sealing relationship of the seal member 165 between the second sub 110 and the barrier assembly 150. As also shown, backup rings 175 are disposed adjacent each side of the second seal member 185. The backup rings 175 are configured to enhance the sealing relationship of the seal member 185 between the first sub 105 and the second sub 110.

The barrier assembly 150 is disposed in a bore 120 of the float sub 100. The barrier assembly 150 includes the frangible member 155. The frangible member 155 may be a rupture disk or any other type of breakable member that is configured to break apart (rupture or shatter) when a predetermined pressure is applied to the frangible member 155. In the embodiment shown, the frangible member 155 is hemispherical dome with a convex surface facing the first sub 105 (i.e., up hole direction). In other embodiments, the frangible member 155 may be other geometrical shapes, such as a cone or disk. The frangible member 155 may be made from materials such as metal, ceramic, glass, composites or combinations thereof.

A support (or "connection") member 160 in the barrier assembly 150 is configured to hold the barrier assembly 150 in the second sub 110. A shoulder 130 in the first sub 105 is configured to limit movement of the barrier assembly 150. As such, the support member 160 and the shoulder 130 are configured to hold the barrier assembly 150 in the float sub 100.

The support member 160 includes tabs 190 that are separated by slots. The tabs 190 in the support member 160 are configured to assist the frangible member 155 breaking at a predetermined force generated by fluid pressure in the bore 120 above the frangible member 155, as described herein. The tabs 190 may be attached to the support member 160 at a weak point such that the tabs 190 break away from the connection member upon application of a force. The tabs 190 are generally disposed around the circumference of the support member 160. In one embodiment, the connection member 160 is tunable to dial-in to a selected shear force. The connection member may be tuned by removing several of the tabs 190 from the support member 160 prior to the assembly of the float sub 100. In other words, the shear value of the support member 160 may be selected based upon wellbore conditions and then the tabs 190 selectively removed to obtain the selected shear value. The remaining tabs 190 may break away from the support member 160 as the frangible member 155 is removed from the barrier assembly 150. In another embodiment, the support member 160 may be ring without tabs 190. In this embodiment, the frangible member 155 is designed to break at a predetermined force generated by fluid pressure. The support member 160 may be made from materials such as metal, ceramic, composite or a combination thereof.

As shown in FIG. 1A, the barrier assembly 150 may be disposed in the bores of the first and second subs 105, HO. In another embodiment, the barrier assembly 150 may be disposed in the bore of one of the first sub 105 or the second sub 110. In a further embodiment, a housing (not shown) may be placed between the subs 105, 110 and the barrier assembly 150 may be placed in the housing.

Figure 2:
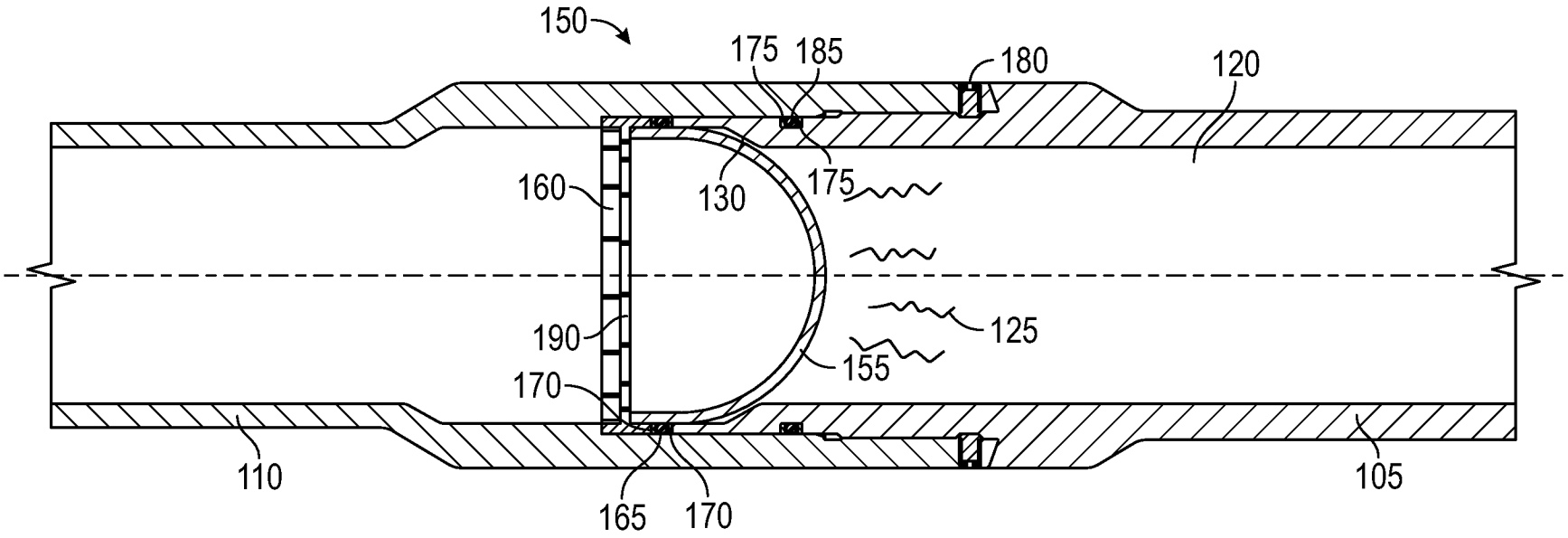
FIG. 2 illustrates a side, cross-sectional view of the float sub prior to rupture of a frangible member, according to an embodiment.

FIG. 2 illustrates a view of the float sub 100 prior to rupture of the frangible member 155. As shown, a predetermined pressure 125 is applied to the frangible member 155. In one embodiment, circulating equipment may be used at the surface of the wellbore to create a fluid pressure in the string of tubulars. In turn, the fluid pressure 125 is applied to the frangible member 155 that is sufficient to break (rupture or shatter) the frangible member 155. The frangible member 155 may be configured to break (burst) at a threshold value of force. The frangible member 155 having a specific threshold value may be selected based upon wellbore conditions. In one embodiment, grooves may be placed on a surface of the frangible member 155 to enhance breakability of the frangible member 155 into small pieces. In another embodiment, the threshold valve may be controlled by the thickness of the frangible member 155.

Figure 3:
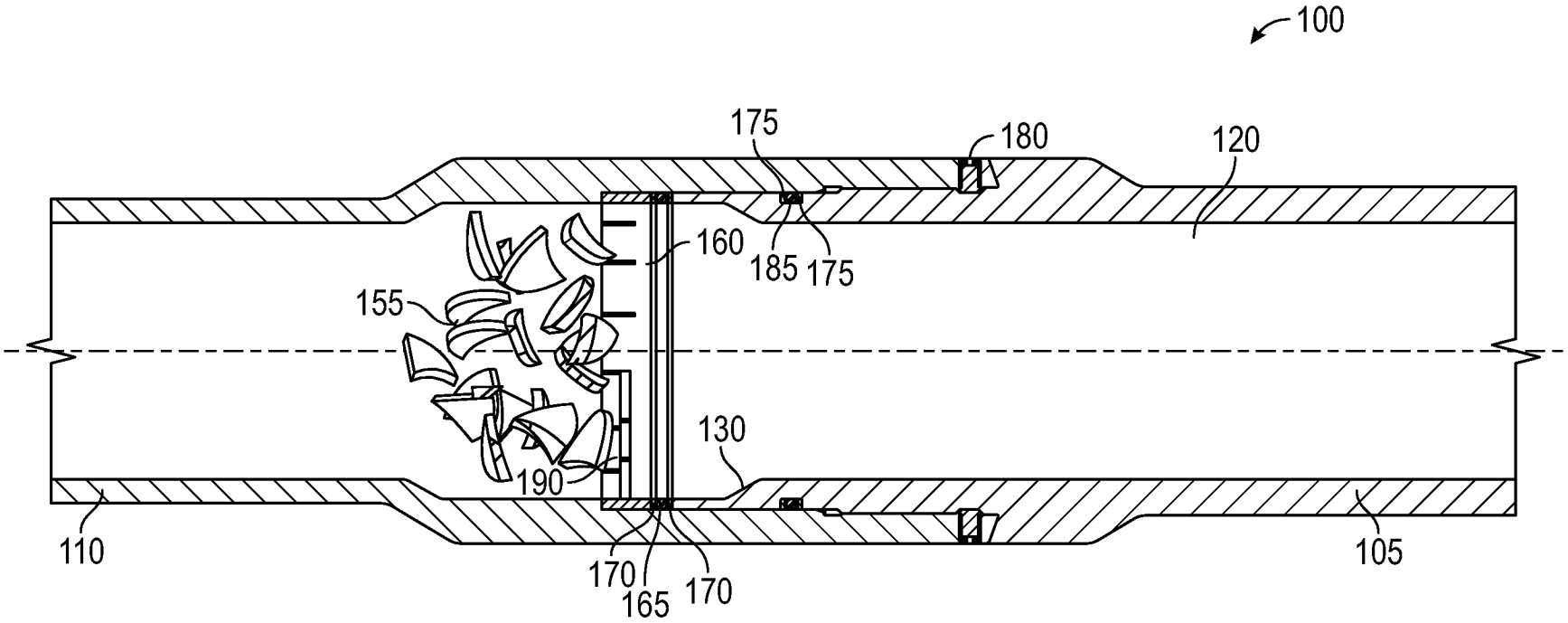
FIG. 3 illustrates a side, cross-sectional view of the float sub after the frangible member is ruptured, according to an embodiment.

FIG. 3 illustrates a view of the float sub 100 after the frangible member 155 is broken. The frangible member 155 is designed to break into many pieces upon application of the fluid pressure 125 (FIG. 2). The pieces of the frangible member 155 are generally small enough to flow through the string of tubulars without interfering with other downhole equipment. When the frangible member 155 of the float sub 100 is broken, the temporary barrier of the isolated portion of the string of tubulars is removed and thus allowing fluid flow into the isolated portion. At that time, the fluid and/or gas in the isolated portion of the string of tubulars may rise to the surface of the wellbore and subsequently vented from the string of tubulars.

Figure 4:
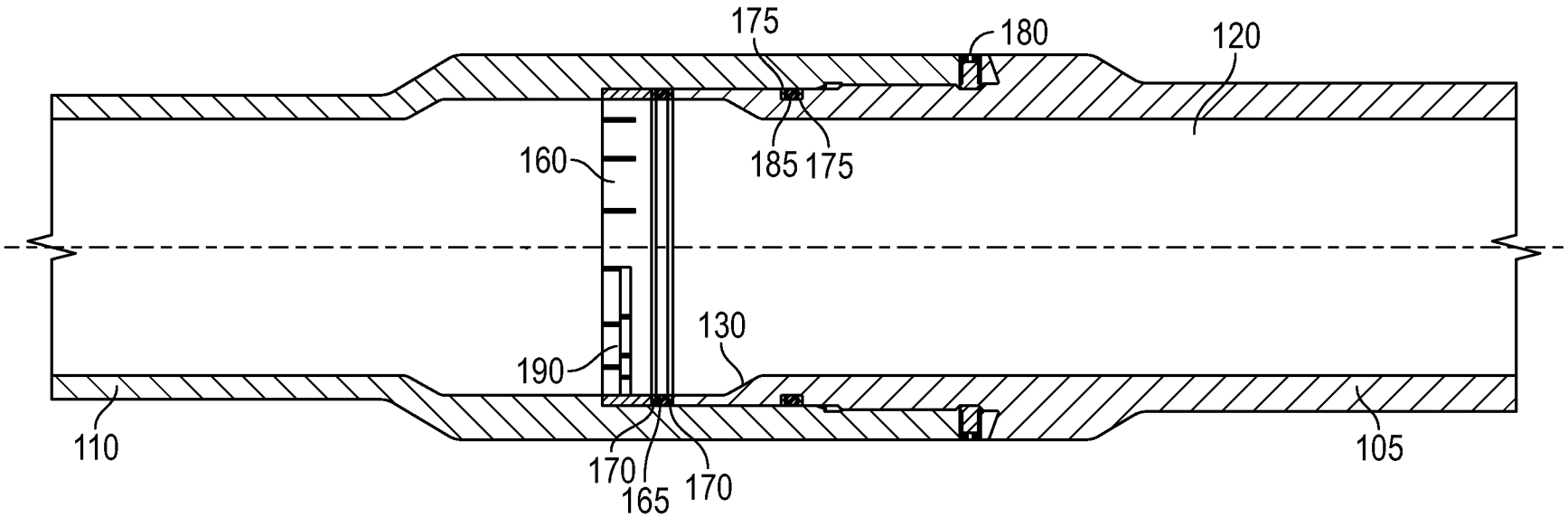
FIG. 4 illustrates a side, cross-sectional view of the float sub without the frangible member (e.g., after rupture thereof), according to an embodiment.

FIG. 4 illustrates a side, cross-sectional view of the float sub 100 without the frangible member 155. After the frangible member 155 is removed from the float sub 100, the bore 120 of the float sub 100 is open to allow for other wellbore operations to be done below the float sub 100.

Figure 5:
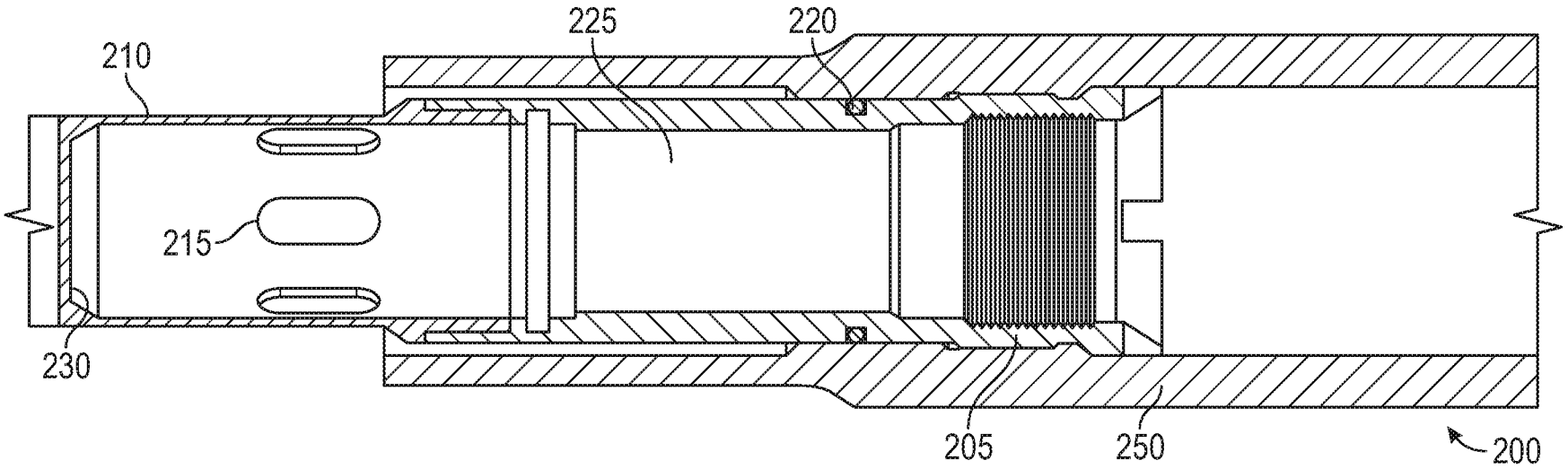
FIG. 5 illustrates a side, cross-sectional view of a debris sub, according to an embodiment.

FIG. 5 illustrates a side, cross-sectional view of a debris sub 200 for use with the float sub 100. The debris sub 200 may be may be placed within the string of tubulars at a location downhole of the barrier assembly 150. The debris sub 200 may be configured to catch the pieces of the frangible member 155 and any tabs 190 that may have broken off from the support member 160 in order to isolate the pieces and the tabs 190 from other portions of the wellbore or equipment in the string of tubulars.

The debris sub 200 includes a sub 205 that is configured to be attached to a tubular 250 (e.g., landing collar) in the string of the tubulars. The debris sub 200 further includes a seal member 220 between the sub 205 and the tubular 250. The debris sub 200 also includes a debris basket 210 having a catch surface 230 that is configured to catch the pieces of the frangible member 155 from the barrier assembly 150 and the tabs 190 from the support member 160. The debris basket 210 includes ports 215 which allows fluid to flow through the debris sub 200. More specifically, fluid flowing in the tubular 250 flows through a bore 225 of the debris sub 200 and then out of the ports 215 of the debris basket 210. The debris basket 210 has a port geometry that results in a combined flow area equal or greater than the flow area through the float equipment (e.g., float shoe and/or float collar) after the debris basket 210 is filled with debris, such as pieces of the frangible member 155 and any tabs 190 from the connection member 160. The ports 215 may be any geometric shape.

Figure 6A:
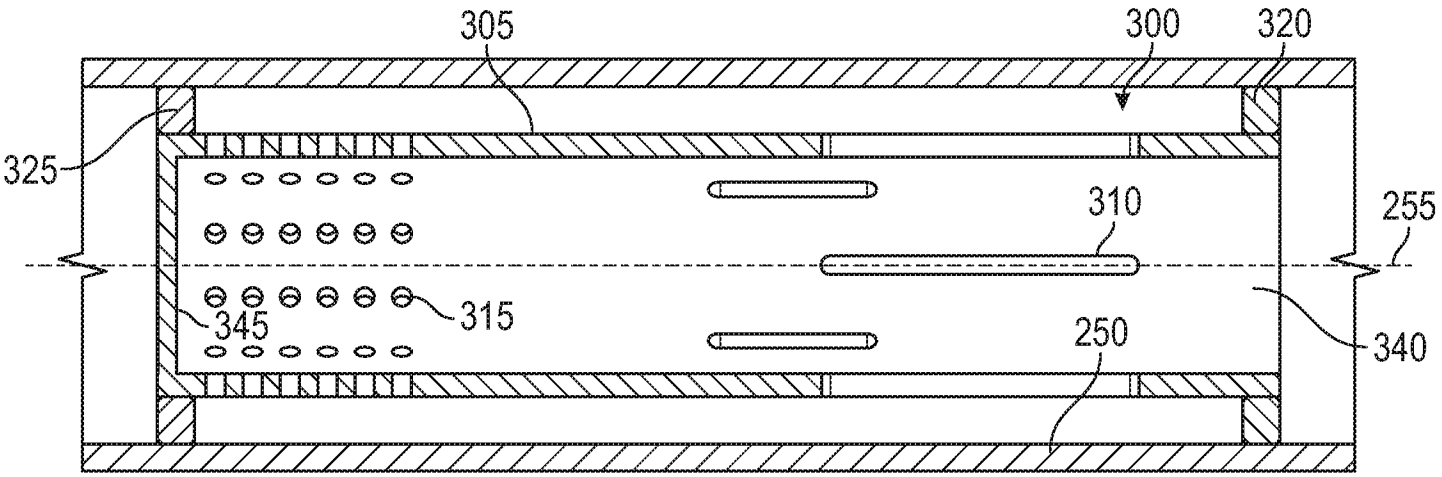
FIG. 6A. illustrates a side, cross-sectional view of a debris catcher, according to an embodiment.

FIG. 6A illustrates a side, cross-sectional view of a debris catcher 300 for use with the float sub 100, according to an embodiment. The debris catcher 300 may be may be placed in the string of tubulars at a location below the barrier assembly 150. Similar to the debris sub 200 (FIG. 5), the debris catcher 300 may be configured to catch the pieces of the frangible member 155 and any tabs 190 that may have broken off from the support member 160 in order to isolate the pieces and the tabs 190 from other portions of the wellbore or equipment in the string of tubulars. However, one difference between the debris sub 200 and the debris catcher 300 is that the debris catcher 300 may be configured to move along (or ride) an inner surface of the tubular 250. In other words, the debris catcher 300 may not be fixed to the tubular 250, but rather the debris catcher 300 may be able to move in an axial direction that us substantially parallel to a centerline 255 of the tubular 250.

The debris catcher 300 includes a body 305. The body 305 includes a catch surface 345 configured to catch debris. The body 305 includes ports 310 and ports 315 to allow fluid to pass through the debris catcher 300. The body 305 has a port geometry that results in a combined flow area equal or greater than the flow area through the float equipment (e.g., float shoe and/or float collar) after the debris catcher 300 is filled with debris, such as pieces of the frangible member 155 and any tabs 190 from the connection member 160. The ports 310, 315 may be any geometric shape.

The body 305 is configured to be supported in the tubular 250 (string of the tubulars) via a first support ring 320 and an optional second support ring 325. The first support ring 320 supports a first end of the body 305 and the second support ring 325 supports a second end of the body 305. The support rings 320, 325 may have a "near drift outer diameter" which allows the support rings 320, 325 the ability to move (or float) in the tubular 250. In one embodiment, the support rings 320, 325 may be gauge rings made from material such as metal, ceramic, composite or combinations thereof. In another embodiment, the support rings 320, 325 may be fins made from an elastomeric material.

Figure 6B:
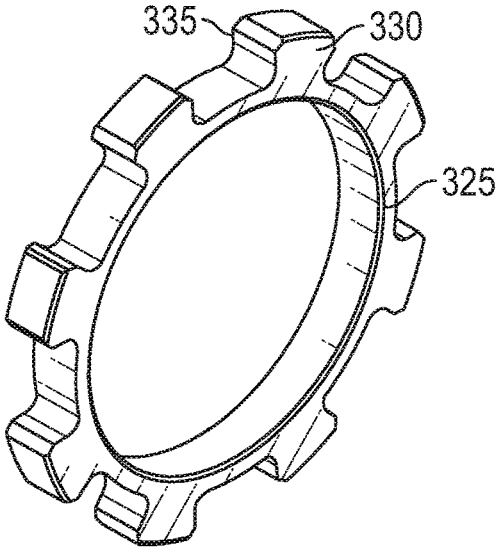
FIG. 6B illustrates a perspective view of a support ring for use with the debris catcher in FIG. 6A.

The first support ring 320 is a solid ring that has an outer diameter in contact with an interior surface of the tubular 250 and an inner diameter attached to an outer surface of the body 305. The second support ring 325 is configured to allow fluid flow to pass by the support ring 325 as shown in FIG. 6B. The support ring 325 includes protrusions 330 along the circumference of the support ring 325. In one embodiment, the protrusions 330 are protruding screws. In between each pair of protrusions 330 is a fluid bypass slot 335. The fluid bypass slot 335 is configured to allow the fluid to pass the support ring 325. In other words, the fluid entering the debris catcher 300 flows through a bore 340 of the catcher 300 and out of the catcher 300 via ports 310, 315. Thereafter, the fluid flows through the fluid bypass slots 335 of the second support member and past the catcher 300.

Figure 7A:
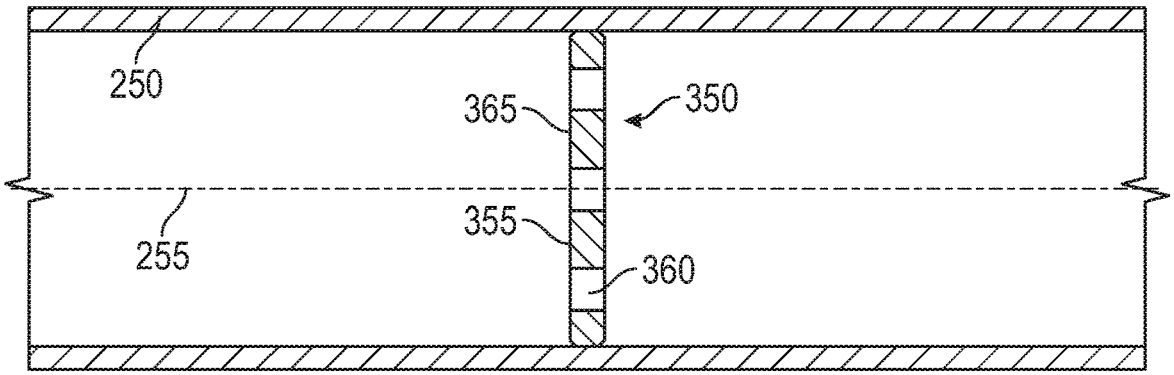
FIGS. 7A and 7B illustrate a side, cross-sectional view and a perspective view, respectively, of a debris catcher according to an embodiment.
Figure 7B:
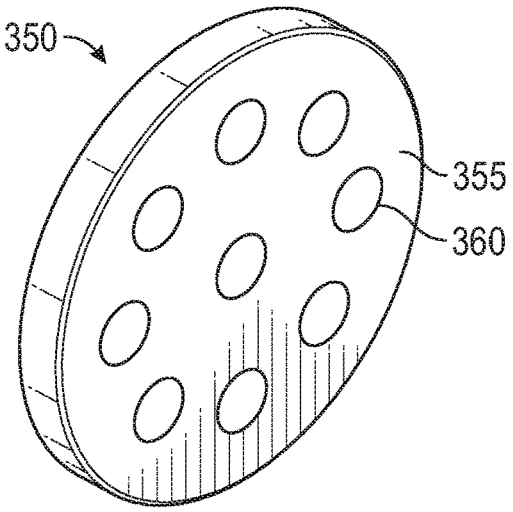

FIGS. 7A and 7B illustrate a side, cross-sectional view of a debris catcher 350 for use with the float sub 100, according to an embodiment. The debris catcher 350 may be may be placed in the string of tubulars at a location downhole from the barrier assembly 150. Similar to the debris sub 200 (FIG. 5), the debris catcher 350 may be configured to catch the pieces of the frangible member 155 and any tabs 190 that may have broken off from the support member 160 in order to isolate the pieces and the tabs 190 from other portions of the wellbore or equipment in the string of tubulars. However, one difference is that the debris catcher 350 may be configured to move along (or ride) an inner surface of the tubular 250. In other words, the debris catcher 350 is not fixed to the tubular 250 but rather the debris catcher 350 has the ability to move in an axial direction that is substantially parallel to a centerline 255 of the tubular 250.

The debris catcher 350 includes a body 355. The body 355 having a catch surface 365 configured to catch debris. The body 355 includes ports 360 to allow fluid to pass through the debris catcher 350. The body 355 has a port geometry that results in a combined flow area equal or greater than the flow area through the float equipment (e.g., float shoe and/or float collar) after the debris catcher 300 is filled with debris, such as pieces of the frangible member 155 and any, tabs 190 from the connection member 160. The ports 360 may be any geometric shape. The body 305 may have a "near drift outer diameter" which allows the body 355 the ability to move (or float) in the tubular 250. In one embodiment, the body 355 may be made from material such as metal, ceramic, composite, elastomeric or combinations thereof.

Figure 8:
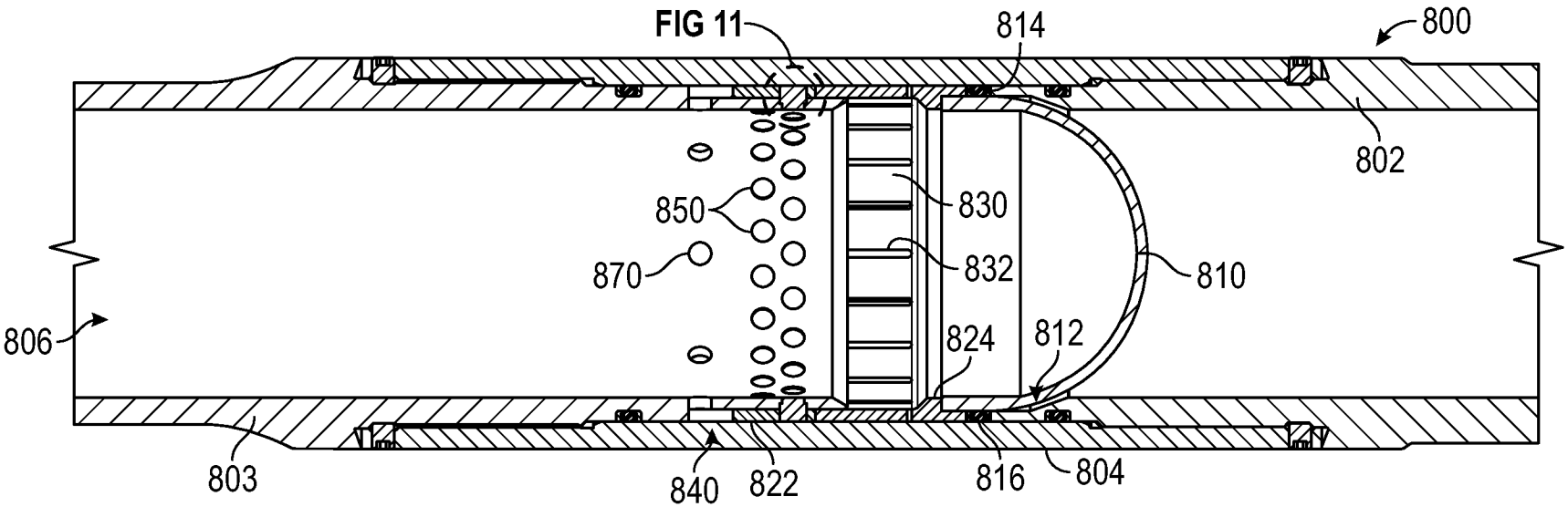
FIG. 8 illustrates a side, cross-sectional view of a float sub, according to an embodiment.

FIG. 8 illustrates a side, cross-sectional view of another float sub 800, according to an embodiment. The float sub 800 may include a first sub 802, a second sub 803, and a housing 804 that extends between and connects together the first and second subs 802, 803. In some embodiments, the first and second subs 802, 803 may be threaded into and sealed with the housing 804. In other embodiments, the first and second subs 802, 803 may be otherwise coupled to the housing 804 and/or the housing 804 may be omitted and the first and second subs 802, 803 may be coupled directly together. The first and second subs 802, 803 may together define a bore 806 extending axially therethrough, e so as to allow flow communication therethrough when the bore 806 is not blocked.

The float sub 800 may include a frangible member 810 that may be positioned in the bore 806 so as to at least temporarily block fluid communication through the bore 806. The frangible member 810 may be generally dome-shaped, although it may also include a cylindrical portion extending from the dome. The frangible member 810 may be positioned in a recess 812 formed at a downhole end 814 of the first sub 802. The frangible member 810 may form a fluid-tight seal with the first sub 802, e.g., via a seal 816, such as an O-ring seal, positioned therebetween. Two or more such seals may be used in some embodiments.

The float sub 800 may further include a support ring (also referred to herein as a connection member) 820 and a shear ring 822. In an embodiment, the support ring 820 may be positioned axially between the first and second subs 802, 803, and radially between the frangible member 810 and the housing 804, at the top end thereof, and radially between the second sub 803 and the housing 804 at the lower end thereof. In some embodiments, the support ring 820 and the shear ring 822 may be integrally formed as a single piece.

The support ring 820 may engage the frangible member 810. For example, the support ring 820 may include an inwardly-protruding shoulder 824, upon which the lower end of the frangible member 810 may be supported. The support ring 820 may further define a plurality of tabs 830, which are separated circumferentially apart by a plurality of slots 832 that extend axially along a portion of the support ring 820. As such, the tabs 830 may be connected together by an integral portion of the support ring 820, e.g., at the top of the support ring 820, including the shoulder 824. The tabs 830 may provide a greater degree of flexibility to the support ring 820 than if the support ring 820 was solid, although in some embodiments, the support ring 820 may be solid.

The shear ring 822 may be positioned in an annulus 840 defined radially between the second sub 803 and the housing 804. The annulus 840 may be larger in axial dimension than the axial extent of the shear ring 822, such that, if free to move, the shear ring 822 may move axially, within the annulus 840, e.g., downhole, as shown. A plurality of shearable members 850 (e.g., shear pins) may connect the shear ring 822 to the second sub 803. The shearable members 850 may be disposed in one or more (e.g., two) rows and may be positioned at intervals around the shear ring 822 and the second sub 803. Further, the shear ring 822 may axially abut the support ring 820. Thus, while the shearable members 850 remain in place, the shear ring 822 may be prevented from moving with respect to the second sub 803, and the support ring 820 may likewise remain in place. However, when the shearable members 850 yield, the shear ring 822 may drop down in the annulus 840, which may likewise allow the support ring 820 to drop. The support ring 820 at least partially dropping may cause the frangible member 810 to tilt, which may initiate fracture of the frangible member 810, as will be described in greater detail below. The provision of the threaded-together first and second subs 802, 803 and the housing 804, may facilitate access to the shear ring 822 and the shearable members 850, which may allow for the number of shearable members 850 to be adjusted, thereby adjusting the bore pressure that causes the shear members 850 to shear.

The second sub 803 may define one or more vent holes 870, which may allow for displacement of gas or fluid from the annulus 840. The vent holes 870 may allow the support ring 820 to move in the annulus 840, as will be described in greater detail below.

Figure 9:
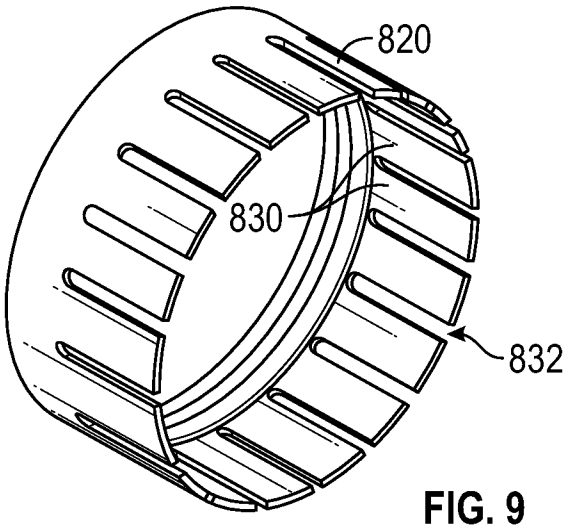
FIG. 9 illustrates a perspective view of a support ring, according to an embodiment.

FIG. 9 illustrates a perspective view of the support ring 820, according to an embodiment. The support ring 820 includes the tabs 830, which are separated circumferentially apart from one another by the slots 832. As mentioned above, the provision of such tabs 830 and slots 832 increases the flexibility of the support ring 820; this allows the support ring 820 to descend in the float sub 800 (FIG. 8) at an angle (e.g., tilted), rather than maintaining concentricity with the first and/or second subs 802, 803, in at least some embodiments. This initiates an unbalanced support of the frangible member 810, which may, in some instances, result in a fracture mode of the frangible member 810, as will be described in greater detail below.

Figure 11:
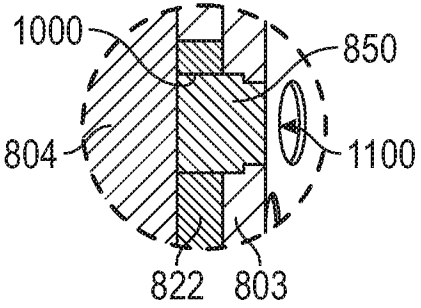
FIG. 11 illustrates an enlarged view of a portion of FIG. 8, showing a shearable member extending in the float sub, according to an embodiment.
Figure 10:
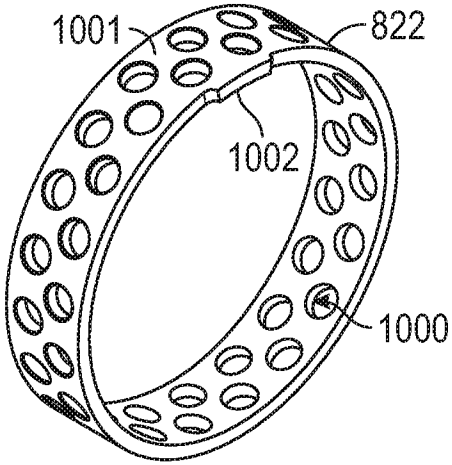
FIG. 10 illustrates a perspective view of a shear ring, according to an embodiment.

FIG. 10 illustrates a perspective view of the shear ring 822, according to an embodiment. As shown, the shear ring 822 includes a body 1001 through which holes 1000 are defined. The holes 1000 may be configured to receive the shearable members 850 discussed above. FIG. 11 illustrates an enlarged view of one of the shearable members 850 received through one of the holes 1000 and into an aligned hole 1100 formed in the second sub 803. Further, the shear ring 822 in FIG. 10 includes a misalignment feature 1002, such as an axially-extending protrusion extending from the remainder of the body 1001.

Furthermore, like the support ring 820, the shear ring 822 may also include a degree of flexibility, either by its geometry or the material (e.g., metal, composite, etc.) from which it is made, or both. Accordingly, for the shear ring 822 to move, only some of the shearable members 850 need to yield, and thus some, e.g., one or more shearable members 850 on one angular interval may remain intact, while the shearable members 850 on another angular interval break. This may result in the shear ring 822 at least partially descending in the annulus 840 at an angle, e.g., tilted non-concentrically to the second sub 803.

Figure 12:
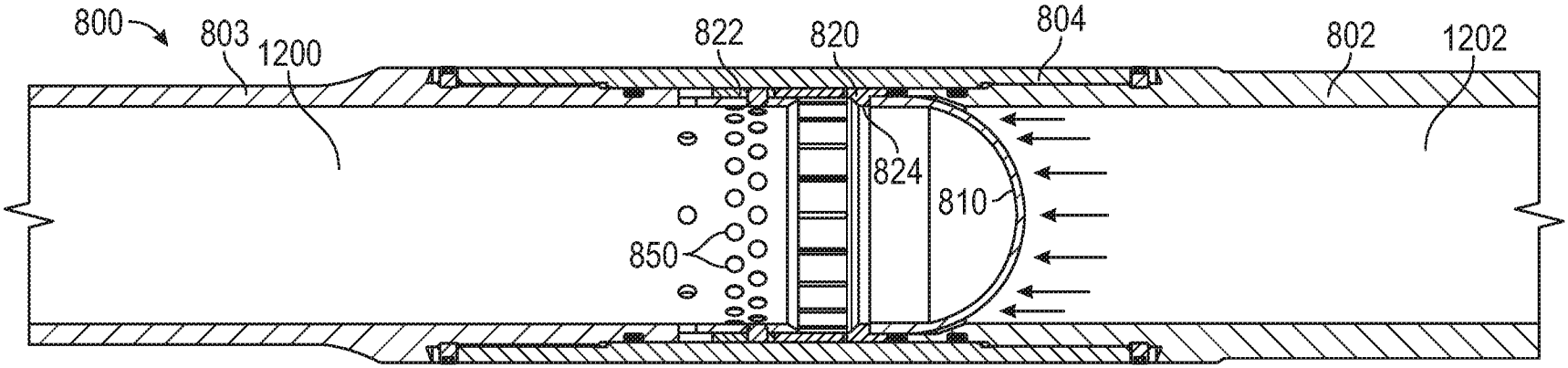
FIG. 12 illustrates a side, cross-sectional view of the float sub of FIG. 8, in a run-in position, according to an embodiment.

Operation of the float sub 800 is now described, beginning with reference to FIG. 12, which shows the float sub 800 in a run-in configuration, according to an embodiment. The frangible member 810 is intact in this position and serves to separate a low-pressure area 1200 downhole from the frangible member 810, from a higher-pressure area 1202 uphole of the frangible member. At some point, it may be desired to establish communication through the bore 806 by removing, in this case, breaking, the frangible member 810.

In order to do so, in at least some embodiments, rather than using a breaker bar, a sleeve, a point or other such mechanical devices to break the frangible member 810, the pressure differential across the frangible member 810 is employed. While the frangible member 810 is in the run-in position, the dome of the frangible member 810 faces upwards, concentrically to the first sub 802, and thus distributes the pressure evenly, generally in the optimal fashion of domed-shape structures.

At some point, due to imperfections in materials, geometry, support, etc., the pressure may result in sufficient force to yield one or more of the shearable members 850. Because the support ring 820 and the shear ring 822 are flexible, one "side" (e.g., angular interval such as about 180 degrees) thereof may drop in the annulus 840 with respect to the second sub 803. Accordingly, the shoulder 824 of the support ring 820 that supports the frangible member 810 may also become canted or tilted, e.g., non-concentric with the first and/or second subs 802, 803. When this occurs, the dome of the frangible member 810 may no longer support the pressure evenly, and as a result, stress concentrations in the frangible member 810 may cause the frangible member 810 to break, ultimately because of this uneven support provided by the support ring 820, again, in some embodiments, without the assistance of a mechanical device impacting, penetrating, or otherwise breaking the frangible member 810.

Figure 13:
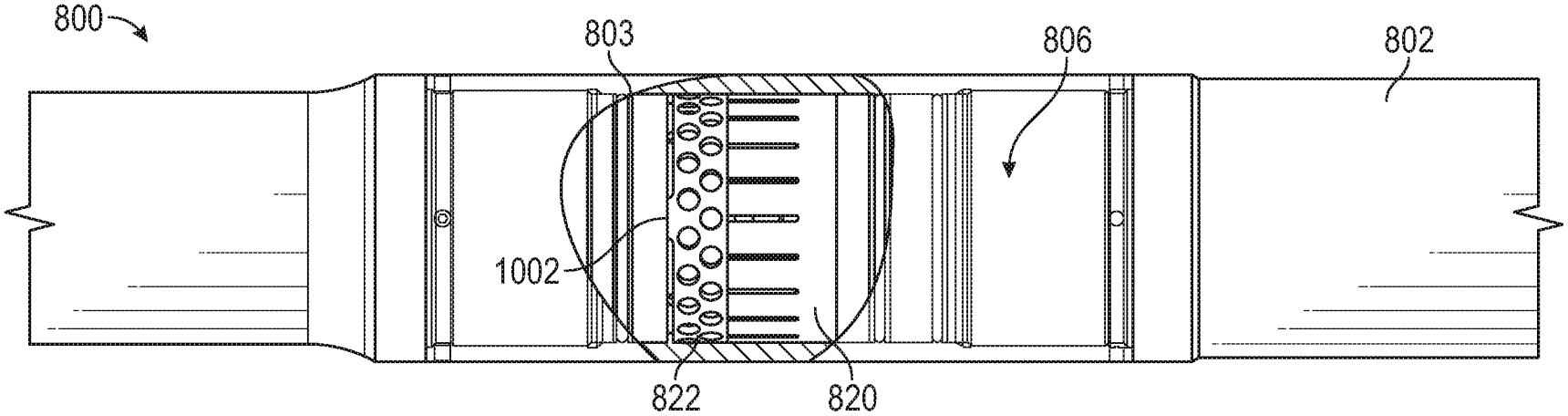
FIG. 13 illustrates a side, partial sectional view of the float sub of FIG. 8, after the frangible member has been removed (e.g., ruptured), according to an embodiment.

Referring now to FIG. 13, the operation of the misalignment feature 1002 of the shear ring 822 may be seen. As there generally may not be a corresponding tab/feature on an opposing side of the shear ring 822, even if all the shearable members 850 break while the frangible member 810 is intact, the misalignment feature 1002 lands on the bottom of the annulus 840 first, and forces the shear ring 822, and thus the support ring 820 and the frangible member 810 to tilt in the bore 806. As a result, the frangible member 810, with its dome no longer being concentric in the first sub 802, may expose a suboptimal support surface that is intended to fail in the presence of a high pressure differential.

Figure 14:
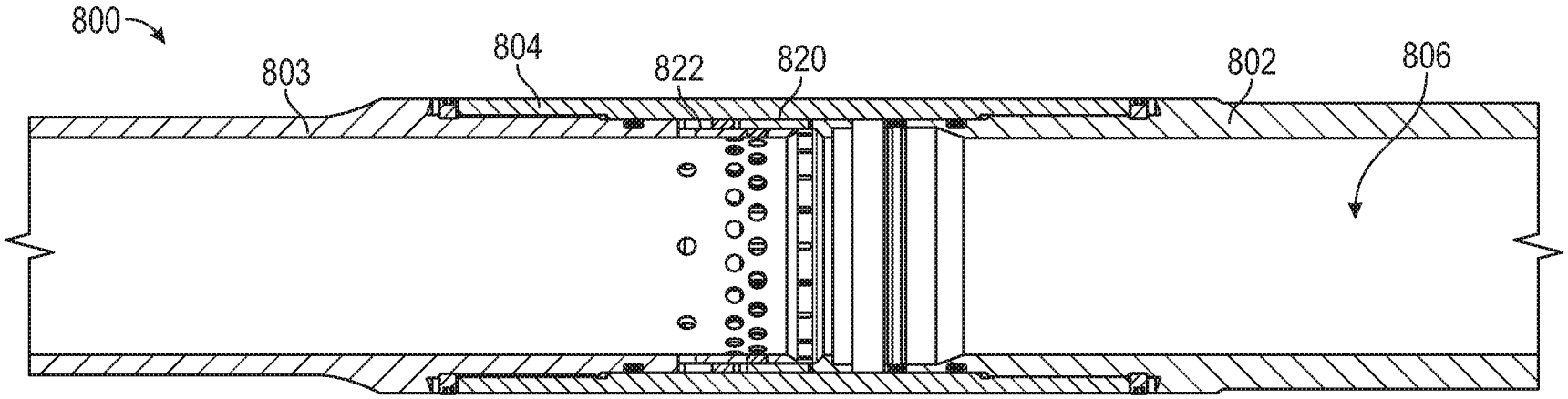
FIG. 14 illustrates a side, cross-sectional view of the float sub of FIG. 8, after the frangible member has been removed (e.g., ruptured), according to an embodiment.

FIG. 14 illustrates a cross-sectional view of the float sub 800 after the frangible member 810 has broken and washed out of the float sub 800, according to an embodiment. As shown, the support ring 820 and the shear ring 822 have dropped in the annulus 840. It will be appreciated, however, that the float sub 800 may not reach this configuration during some operation. For example, at least some of the shearable members 850 (e.g., FIG. 12) may remain intact, while the shear ring 822 and the support ring 820 may wind up in a tilted orientation, even after the frangible member 810 is broken. This illustration of the float sub 800 after the frangible member 810 has broken is therefore merely an example to illustrate the full range of motion available.

As used herein, the terms "inner" and "outer", "up" and "down"; "upper" and "lower"; "upward" and "downward"; "above" and "below", "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An apparatus for use in a string of tubulars, the apparatus comprising:

a first sub having a bore;

a second sub attached to the first sub, the second sub having a bore in fluid communication with the bore of the first sub;

a barrier assembly having a frangible member that is configured to break by applying a fluid pressure to the frangible member;

a misalignment feature coupled to the barrier assembly; and one or more shearable members coupled to the barrier assembly and configured to prevent the frangible member from moving with respect to the first and second subs until at least one of the one or more shearable members yields, wherein, when at least one of the one or more shearable members shears under a force applied by fluid pressure on the frangible member, the frangible member moves axially toward the second sub and the misalignment feature engages the second sub, causing the frangible member to tilt with respect to a central axis of the first sub, the second sub, or both.

2. The apparatus of claim 1, wherein the frangible member is configured to break by applying the fluid pressure alone, without engagement of any mechanical devices with the frangible member.

3. The apparatus of claim 1, wherein the barrier assembly further includes a connection member engaging the frangible member.

4. The apparatus of claim 3, wherein the connection member comprises a ring having a plurality of tabs disposed around a circumference of the ring.

5. The apparatus of claim 4, wherein the plurality of tabs are configured to shear from the ring at a predetermined force.

6. The apparatus of claim 4, wherein the barrier assembly further comprises a shear ring, wherein the shear ring abuts the connection member, so as to at least temporarily maintain a position of the connection member and the frangible member with respect to the bore, wherein the misalignment feature extends away from an end of the shear ring, such that the misalignment feature engaging the second sub causes the shear ring to tilt, and wherein the shear ring tilting causes the connection member to tilt, which causes the frangible member to tilt.

7. The apparatus of claim 6, wherein the misalignment feature comprises a tab that extends axially from the end of the shear ring.

8. The apparatus of claim 6, further comprising a housing that connects together the first and second subs, wherein the shear ring is positioned in an annulus at least partially defined radially between the second sub and the housing, the annulus being larger in axial dimension than the shear ring.

9. The apparatus of claim 1, further including a housing between the first and second subs, wherein the barrier assembly is disposed in the housing.

10. A method of placing a string of tubulars in a wellbore, the method comprising:

installing a float sub in the string of tubulars to form an isolated portion in the string of tubulars, the float sub including:

a first sub having a bore;

a second sub attached to the first sub, the second sub having a bore in fluid communication with the bore of the first sub;

a barrier assembly having a frangible member that is configured to break by applying a fluid pressure to the frangible member;

a misalignment feature coupled to the barrier assembly; and one or more shearable members coupled to the barrier assembly and configured to prevent the frangible member from moving with respect to the first and second subs until at least one of the one or more shearable members yields, wherein, when at least one of the one or more shearable members shears under a force applied by fluid pressure on the frangible member, the frangible member moves axially toward the second sub and the misalignment feature engages the second sub, causing the frangible member to tilt with respect to a central axis of the first sub, the second sub, or both;

placing a low-density fluid or gas in the isolated portion of the string of tubulars;

lowering the string of tubulars into the wellbore, wherein the low-density fluid or gas creates a buoyant force in the string of tubulars to facilitate placing the string of tubulars in the wellbore; and applying a fluid pressure in the string of tubulars to break the frangible member of the float sub after the string of tubulars is placed in the wellbore.

11. The method of claim 10, wherein the float sub further includes a connection member attached to the frangible member, the connection member having a plurality of tabs.

12. The method of claim 11, wherein the plurality of tabs are configured to assist the frangible member to break upon application of the fluid pressure.

13. The method of claim 11, wherein the connection member is tunable to a specific shear force by removing a selected number of tabs.

14. The method of claim 10, wherein applying the fluid pressure causes the one or more of the shearable members of the float sub to yield, wherein the one or more shearable members yielding results in a support ring of the float sub moving relative to a housing of the float sub, and wherein the support ring moving results in the frangible member rupturing by applying the fluid pressure.

15. The method of claim 14, wherein the one or more shearable members, prior to yielding, hold a shear ring of the float sub in place relative to the frangible member, the shear ring supporting the support ring, and the support ring supporting the frangible member, wherein the one or more shearable members yielding allows the shear ring, the support ring, and the frangible member to move relative to the housing.

16. The method of claim 14, wherein the shear ring comprises the misalignment feature, such that the one or more of the shearable members yielding results in an unbalanced support of the frangible member, such that the frangible member is tiled with respect to a central axis of the float sub.

17. An apparatus for use in a string of tubulars, the apparatus comprising:

a first sub having a bore;

a second sub attached to the first sub, the second sub having a bore in fluid communication with the bore of the first sub;

a barrier assembly having a frangible member that is configured to break by applying a fluid pressure to the frangible member;

means for retaining the frangible member in place with respect to the first sub, the second sub, or both, until a predetermined hydraulic pressure differential across the frangible member is reached, wherein, when the predetermined hydraulic pressure differential is reached, the means for retaining permit the frangible member to move toward the second sub; and means for tilting the frangible member with respect to a central axis of the bore of the first sub, the bore or the second sub, or both, wherein the means for tilting engage the second sub after the means for retaining the frangible member release, causing the frangible member to tilt.

18. The apparatus of claim 17, wherein the means for retaining comprise a plurality of shearable members coupled to the first sub, the second sub, or both and the barrier assembly.

19. The apparatus of claim 18, wherein the barrier assembly includes a shear ring coupled to the shearable members, and wherein the means for tilting comprise a tab extending axially from the shear ring, the tab being configured to engage the second sub so as to cause the shear ring and the frangible member to tilt.

20. The apparatus of claim 17, wherein at least a portion of the frangible member has a dome-shape, wherein, before the means for retaining release, the dome-shape of the frangible member is aligned with the bore of the first sub, the bore of the second sub, or both, such that the dome-shape distributes the fluid pressure, and wherein tilting the frangible member misaligns the dome-shape with the bore of the first sub, the bore of the second sub, or both, thereby changing a distribution of pressure on the dome-shape and reducing a pressure differential at which the frangible member ruptures.

* * * * *